United States Patent [19]

Aquino

[11] Patent Number: 4,621,653

[45] Date of Patent: Nov. 11, 1986

[54] WINDSHELL

[76] Inventor: Peter Aquino, 12315 Exbury St., Herndon, Va. 22070

[21] Appl. No.: 663,939

[22] Filed: Oct. 23, 1984

[51] Int. Cl.[4] ..... E04H 15/58

[52] U.S. Cl. ..... 135/117

[58] Field of Search ..... 135/117, 87, 102, 106, 135/109, 107, 112

[56] References Cited

U.S. PATENT DOCUMENTS

| | | | |
|---|---|---|---|
| 709,528 | 9/1902 | Webber | 135/102 |
| 778,628 | 12/1904 | Booker et al. | 135/112 |
| 1,169,702 | 1/1916 | Washburn | 135/90 |
| 1,820,002 | 8/1931 | Forrester | 135/107 |
| 2,190,566 | 2/1940 | Julian | 135/87 |
| 2,660,186 | 11/1953 | Marshall et al. | 135/87 |
| 2,690,185 | 9/1954 | Pomykala | 135/101 |
| 2,698,178 | 12/1954 | Williams | 135/102 |
| 2,886,047 | 5/1959 | Healy | 135/107 |
| 2,980,124 | 4/1961 | Atchison | 135/106 |
| 3,010,464 | 11/1961 | Moss | 135/106 |
| 3,042,053 | 7/1962 | Gabriel | 135/87 |
| 3,448,748 | 6/1969 | Walrave | 135/106 |
| 3,683,427 | 8/1972 | Burkholz et al. | 135/91 |
| 3,724,473 | 4/1973 | Moss | 135/97 |

FOREIGN PATENT DOCUMENTS

| | | | |
|---|---|---|---|
| 210079 | 7/1960 | Fed. Rep. of Germany | 135/117 |
| 35905 | 5/1959 | United Kingdom | 135/87 |

*Primary Examiner*—Robert A. Hafer
*Assistant Examiner*—Danton DeMille
*Attorney, Agent, or Firm*—Eugene Sabol; Virgil H. Marsh; Barry I. Hollander

[57] ABSTRACT

A sandshell umbrella is selectively collapsible and foldable so as to form in an erect position a generally sandshell-shaped shelter which is supported by struts at any desired height. The sandshell side walls are formed by a sheet of material which is relatively flexible and is supported by S-shaped struts formed generally of two similarly shaped and sized curved members, which are attached by a foldable joint so that the overall structure can be folded. An upper cross bar separates the two pairs of S-shaped struts at a top portion at an end of each of the S-shaped struts, and a lower cross bar separates the bottom ends of the S-shaped struts; the upper bar being generally shorter than the lower cross bar. Also, a cross support is disposed intermediate the upper and lower cross bars, so as to support the S-shaped strut members at their mid-sections. Each of the cross bars and the cross support member are foldable about a middle portion thereof. This allows collapsing of two assembled sections into a compact, folded bundle for storage or carrying. Connectors are employed to attach each section to one or more adjacent sections to form a larger structure. Each section is usable separately from the other sections.

3 Claims, 27 Drawing Figures

FIG. 3a.
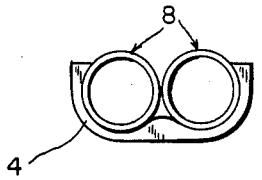
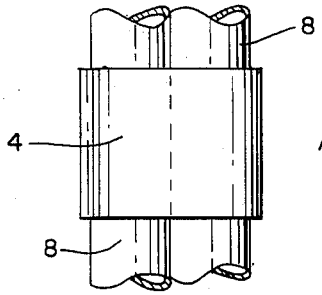
FIG. 3.
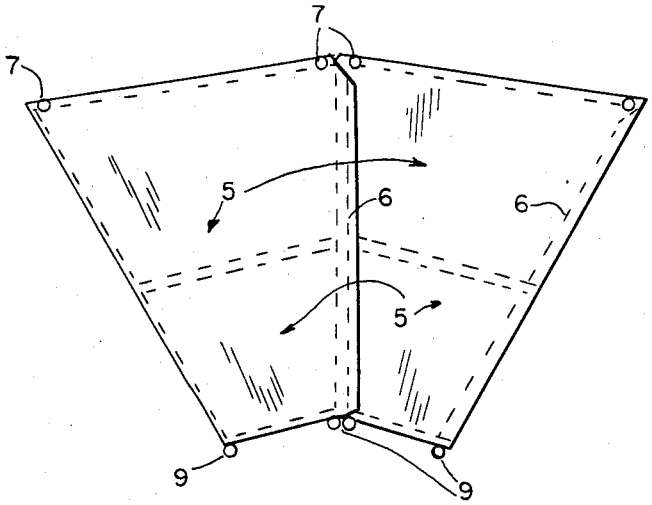
FIG. 2.
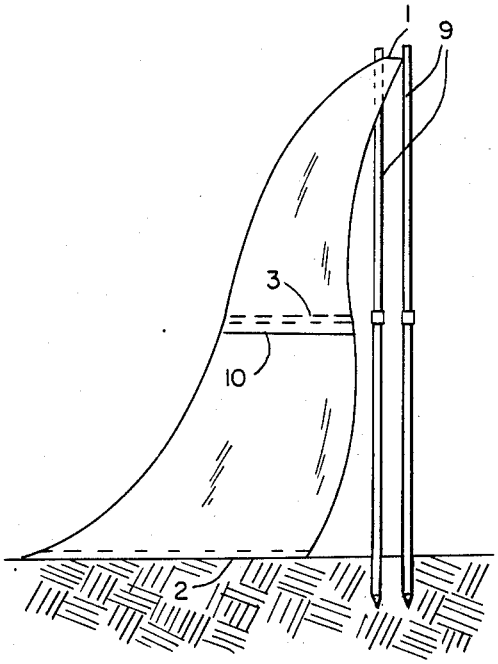
FIG. 4.
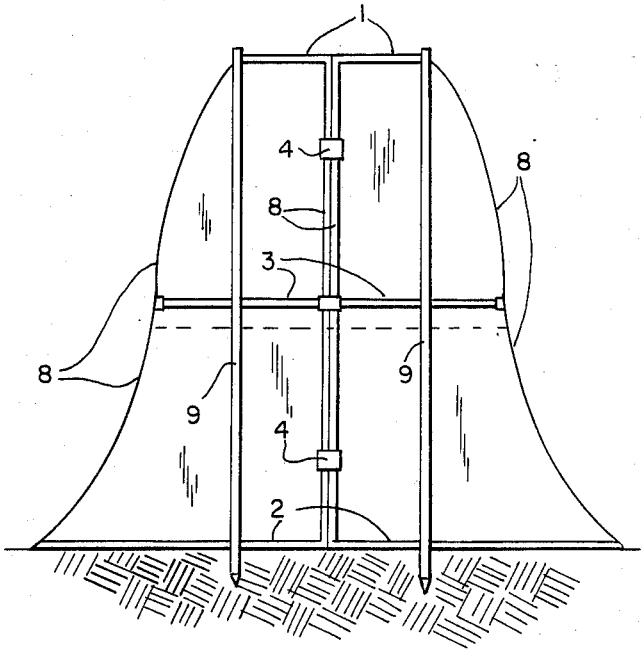
FIG. 1.

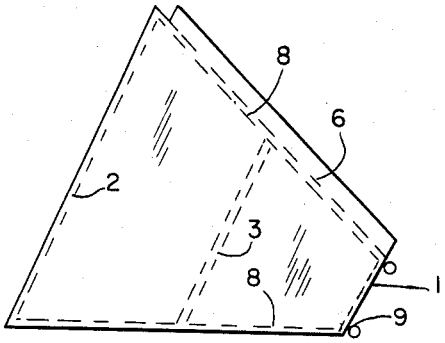
FIG. 5.
FIG. 6.
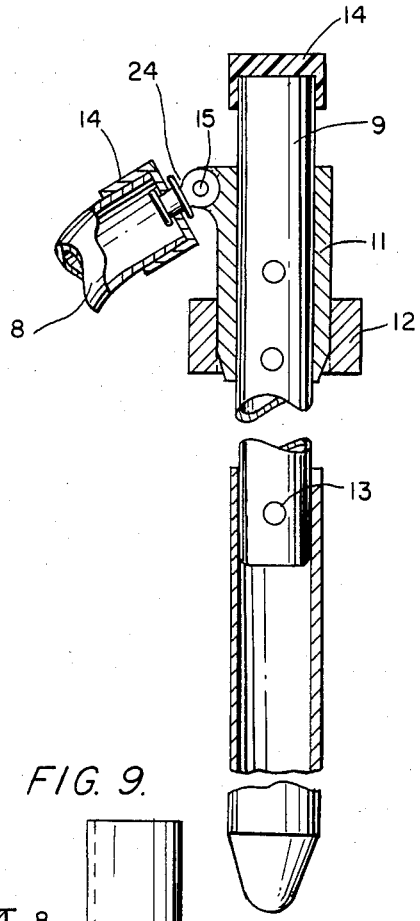
FIG. 7.
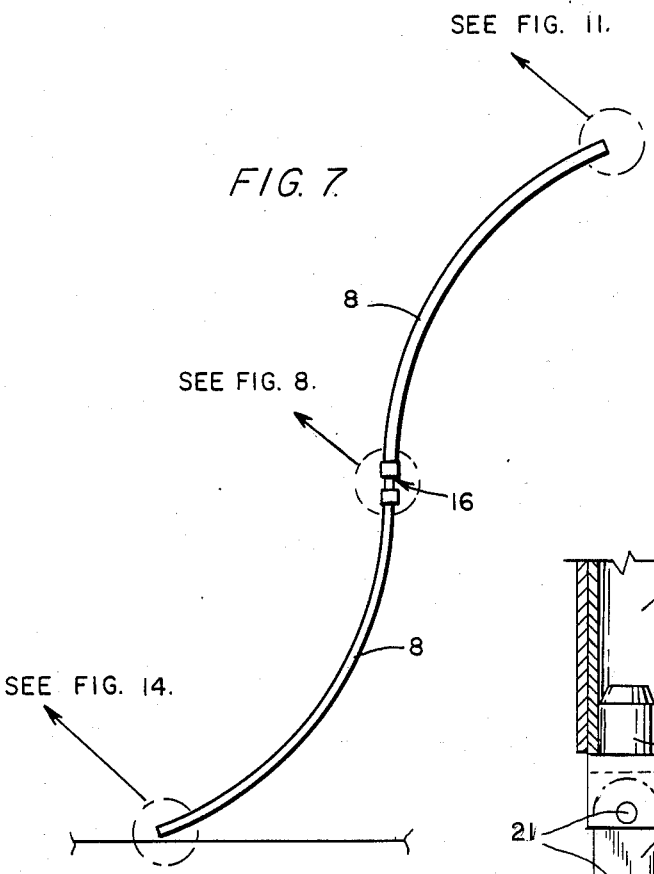
FIG. 9.
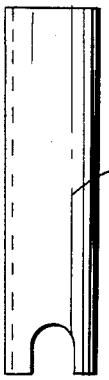
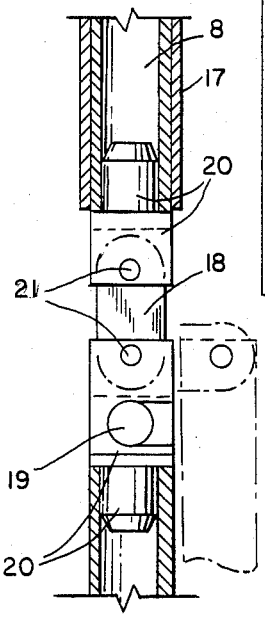
FIG. 8.
FIG. 10.
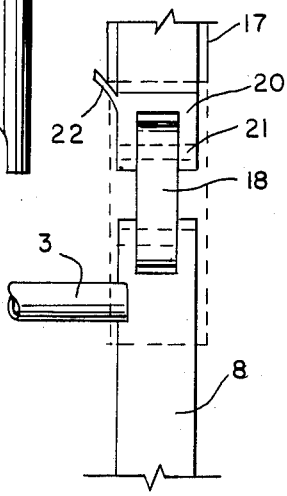

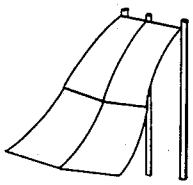
FIG. 15.
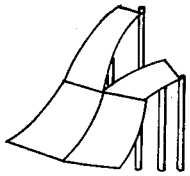
FIG. 16.
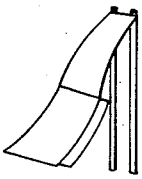
FIG. 17.
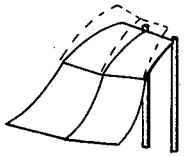
FIG. 18.
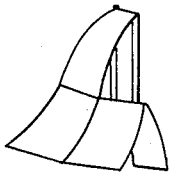
FIG. 19.
FIG. 20.
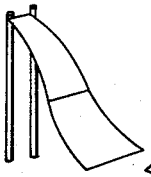
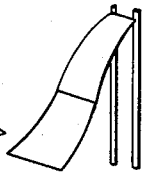
FIG. 20a.
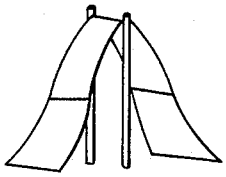
FIG. 21.
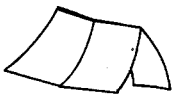
FIG. 22.

FIG. 23.
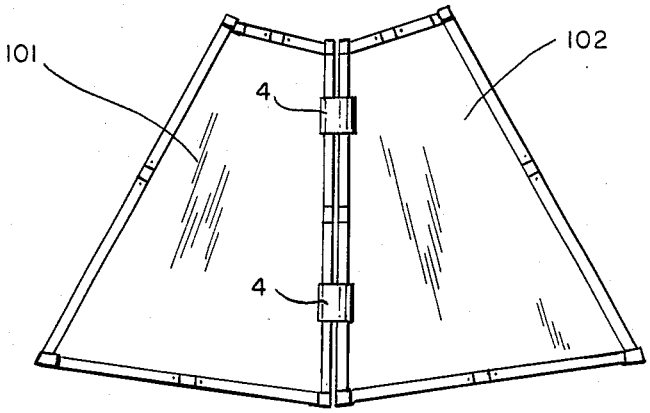
FIG. 24.
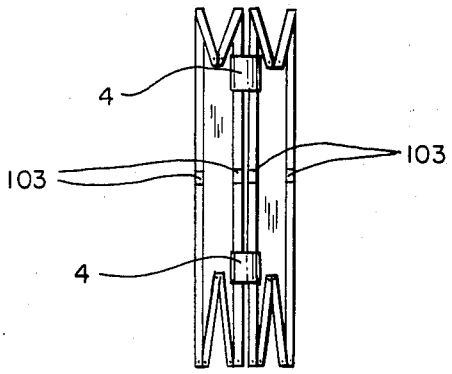
FIG. 25.
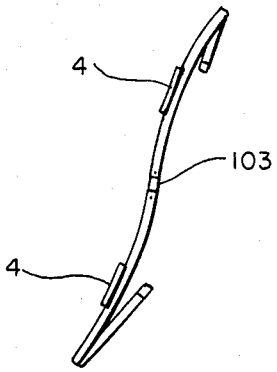
FIG. 26.
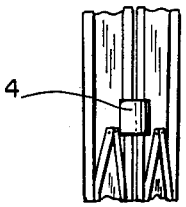
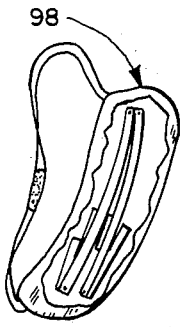
FIG. 27.

WINDSHELL

BACKGROUND OF THE INVENTION

Heretofore tents and canopies having generally linear frames have been used and are well known. Also, collapsible and portable tents and canopies are well known.

However, the prior art devices do not generally have attractive appearance and shapes. Further, the prior art devices do not employ complex curved shapes to form a shell-like screen or canopy member as would be very useful as a baffle for protection against wind.

SUMMARY OF THE INVENTION

This invention relates to improvements in beach umbrellas, tents, or similar objects used for portable shelter against wind, sun, rain, or even snow. From one to many trapezoidal sections can be connected. An important objective of the invention is to have a device which is lightweight, collapsible, an portable so that it can be easily opened and locked into place. This invention is ideal for providing shade and protection on hot beaches, in parks, at sporting events, or anywhere needed. It is designed to be windproof, strong, and waterproof.

This multipurpose device can also become one of the best forms of advertisement. For example, an applied slogan can be seen by people on a crowded beach and undoutedly promote sales. Logos, rock bands, Universities, or almost any design can be colorfully printed onto the body.

As can be seen in the following, common parts are employed to minimize production costs while maximizing the utility of the piece parts where possible.

BRIEF DESCRIPTION OF THE DRAWINGS

FIG. 1 is a front view of the basic unit having two sections;

FIG. 2 is a top view of the basic unit of figure 1;

FIG. 3 is an enlarged view of a clamp used in the present invention to connect sections;

FIG. 3*a* as a top view of the clamp of FIG. 3.

FIG. 4 is a side elevational view of the device of FIG. 1;

FIG. 5 is a top view of a single section;

FIG. 6 is a sectional view, enlarged, of an upright pole which is used to support the construction at multiple heights;

FIG. 7 is a side skeletal view showing the curved aero dynamic design that the ribs take;

FIG. 8 is a sectional view of a swinging joint which is lockable in use with the present invention;

FIG. 9 is a view of a small piece of locking tube;

FIG. 10 shows a cross support member used in the invention;

FIGS. 15–22 are illustrations of various alternative final embodiments of the present invention;

FIG. 23 is a top view of the sections prior to being folded;

FIG. 24 shows upper and lower cross bars being unsnapped and the sections being folded;

FIG. 25 is a side view of the sections shown in FIG. 24 being folded;

FIG. 26 shows the device folded such that the ribs are collapsed to half-rib size; and FIG. 27 shows the small, folded device fitting into a bag.

DETAILED DESCRIPTION OF THE INVENTION

Figure 11:
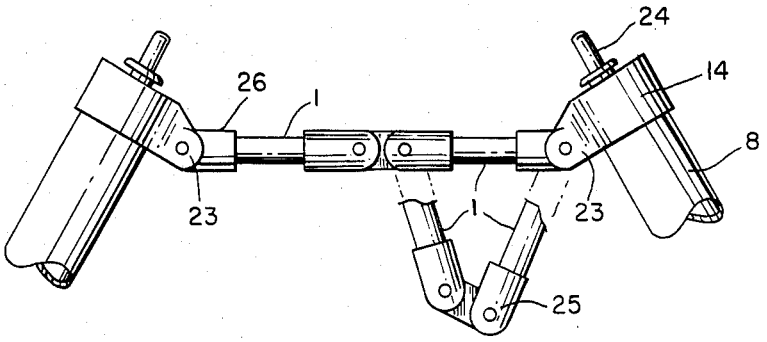
FIG. 11 shows the tips of two upper ribs joined by an upper crossbar which breaks inward as part of the collapsing process.

FIG. 1 is a front view of the windshell of the present invention, the windshell having upper crossbars 1 and lower crossbars 2. Cross supports 3 are intermediate the upper and lower crossbars 1, 2.

Section connectors 4 are used to connect the two sections together, the device of FIG. 1 having two sections which, when connected together, form a single unit. Ribs 8, having a curvilinear shape, support the edges of the windshell.

The crossbars 1, 2 and the cross supports 3, together with ribs 8, form a support for a fabric or other flexible material which actually acts as a wind barrier.

A pair of upstanding vertical support members 9 are seen in FIG. 1. These straight, light weight poles 9 may be made of metal or plastic to secure the construction upright.

FIG. 2 is a top elevational view of the device of FIG. 1 showing the fabric material 5, which is preferrably lightweight and waterproof, attached and stretched between the frame members. An overlap 6 is formed between the two sections. This overlap may be a detachable attached portion fastened by, for example, hook-and-loop fasteners, snaps, or the like. Eyelets 7 are sewn into the body to allow the structure to be anchored to the ground by rope or by pegs. The eyelets may be any conventional eyelets such as metal rings which keep the hole from tearing the fabric 5.

In FIGS. 1 and 2, the upper and lower crossbars 1, 2 can be collapsed inward to bring upper and lower sections of the ribs 8 together if folding of the assembly is desired.

FIG. 3 is a front view and FIG. 3*a* is a top view of a connector 4 assemblying two of the adjacent tubes 8 together. As seen, the connector 4 is generally "W" shaped. This connector may be made of metal or plastic as desired and is preferrably of resilient material so that it may be reused.

FIG. 4 is a side elevational view of the device of FIGS. 1 and 2. Here, the S-shaped ribs 8 (unnumbered in FIG. 4) are seen more clearly. As seen in FIG. 4, the invention has a generally shell shape and appearance due to its curvilinear shape.

The two sections referred to as being connected together, may, when taken apart be folded and closed so as to occupy little room. This is accomplished by selective removal of, for example, crossbars 1 and 2 and the cross supports 3 as desired. The detailed structure permitting the folding is shown in the following.

FIG. 5 is a top view of a single one of the sections referred to above. The overlap 6 is needed on only one side.

FIG. 6 is an exploded view of the portion indicated as a dotted outline of a circle in FIG. 5. This shows the rib 8 manner of attachment to a pole 9. In FIG. 6, the actual circled area is in elevational view in FIG. 5 and is in side view in FIG. 6.

The supporting pole 9 is collapsible, as seen in FIG. 6, to one-half of its maximum height. It may be of metal or plastic, and may have a sharpened or pointed bottom tip for planting in the ground. A sliding collar 11 can be located anywhere on the pole and secured in position by a locking nut 12. The nut is turned into the collar 11 by pressing it to remain in position on the pole. A spring loaded stopper 13 locks the pole at various heights. A number of holes are available for selecting differing heights. By way of example, the full collapse will equal, preferrably, 27 inches.

Caps 14, of resilient material (for example plastic, rubber, or the like) are placed on all exposed rib tips for safety purposes. These tips may, however, be omitted if desired. A small elbow channel 23 (not shown in FIG. 6 but shown in detail in FIG. 11) would be part of the cap. Plastic, tin, or metal-like loops 24 are placed in upper rib caps only for the purpose of the elbow channel 15 connection built into the pole's collar 11. For example, if the nut 12 is loosened, the collar 11 slides down, and the top section swings down to a preferred lower pitch. This top section will not swing unless the middle link 18 is free. The link cover is shown in FIGS. 8–10 which is discussed in the following.

As the pin loops 24 pivot in the collar of the elbow channels 15, poles 9 must be moved out away from their base. The poles will be partially collapsed and locked in; the nut 12 will lock the collar in place; and hook-and-loop fastener tips in the horizontal mid-section portion 10 will be an additional support or hold for the section suspension.

The lower rib caps 14 will be the same as the upper rib caps except for the pin loops 24 which are only needed for full hook-ups, as seen further in FIGS. 11–14.

FIG. 7 shows the contour of the ribs 8. As seen in the figure, the vertical midpoint is the juncture of two symetrical curved ribs 8 which are alined to lie in the same generally vertical plane so that an S-shape member is formed. These ribs are intended to be identical and therefore interchangable in order to simplify the manufacturing process and also to minimize size of the collapsed structure when folded for storage. All upper ribs 8 can rotate directly onto its corresponding lower rib due to the middle joint 16 which is permanently placed at the interface of the upper and lower ribs 8.

FIG. 8 is a detailed view of the middle joint 16, which keeps the ribs fixed in place lying with their curves in the same plane. The middle joint 16 enables the upper ribs to swing over forward and directly underneath the lower ribs, or alternatively backwards directly above the lower ribs. The structure enabling this is the two pivot points 21 which permit rotation of the connected members in a single plane. Joint plugs 20 are stationary while the link 18 is free to rotate in its one-way channel, with the link cover 17 being upwards.

The middle joint 16 may be formed of either plastic or metal, or any combination of the plastic and metal parts, or any other parts which are capable of sustaining the required loads. The joint plugs 20 are preferrably made of a resilient material such as plastic or rubber. The plugs fit into the upper and lower ribs 8 at the interface betweem them. A lock pocket 19 is located in the middle joints bottom half, so as to be molded into it to provide a socket where the cross support 3 (as seen in FIG. 10) can be popped or pushed in to add to the stability of the section.

The FIG. 8 also shows in dotted outline the bending or collapsing of the two sections 8 relative to one another about the pivot points 21.

FIG. 9 shows a locking tube 17 used to be lowered to retain the cross support 3. The cross support 3, upon being popped into its lock pockets 19, is secured by the lowering of the tubes 17 into place. This is shown more clearly in relation to the other parts in FIGS. 8 and 10. The link 18, when covered by the locking tube 17, will be fully covered by the link cover 17 when it is lowered into locking position. The link cover 17 is slightly larger than a usual rib size and is retained above middle joint 16 and the link 18 by a small metal or plastic stopper 22 (shown in FIGS. 8 and 10). The stopper 22 may also be composed of any other material of sufficient strength. When the structure is placed in its upright position as in FIGS. 1, 2, or 4, the link cover 17 can be passed beyond the stopper 22 when the stopper 22 is pressed in, thus freeing the link cover to slide. The retainer groove is used to not only secure the S-shaped form of one full rib, but also to keep the cross support 3 firmly in place. When the upper section is swung over the lower section, the links are horizontal and the link covers are therefore not in use.

FIG. 10 is a side elevational view of the items described in FIGS. 8 and 9. As seen in the drawing, the parts are assembled as described and the stopper 22 is shown in true side view.

FIG. 11 illustrates another collapsible part, for the cross-bar 1. The plastic caps 14 have extending elbow joints 23 built into them as part of the caps 20 as to allow an inward angular movement when the collapsing hinge 25 is "broken" inward, that is, when it is bent inward. The elbows 23 are attached to the upper cross-bar ends 26. As seen in the illustration adjacent the dashed arc suggesting the collapsing movement, when the cross-bars are collapsed, the ribs in a section will come together thereby closing the section. In this case, the loose cross support 3 must be previously removed for collapsing or folding to occur.

Figure 12:
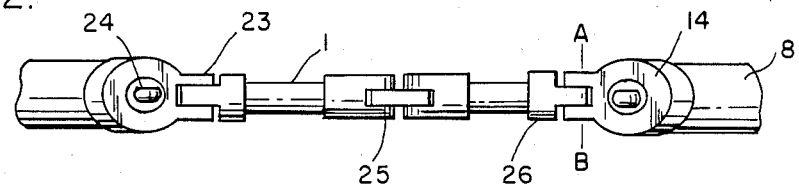
FIG. 12 is a front view of an upper crossbar fitting into elbow joint channels.

FIG. 12 illustrates the front view of the upper cross bar, showing the extended elbow joint channels 23 and the cross bar ends 26. The channels 23 are female cuplings, while the cross bar ends are male cuplings. These are held together preferrably with a metal or other type of pin through points A-B. This pin will allow rotation at the points above-mentioned. The pin loops 24 shown are necessary for pole attachments. The pin loops 24 are not necessary and would not be present for bottom caps. The collapsing hinge 25 will lock perfectly in place when the section is expanded providing a sturdy support. This joint may also be made of plastic, metal, or any other sufficiently strong material, and is pinned to allow rotation of the parts while permanently connecting them together.

Figure 13:
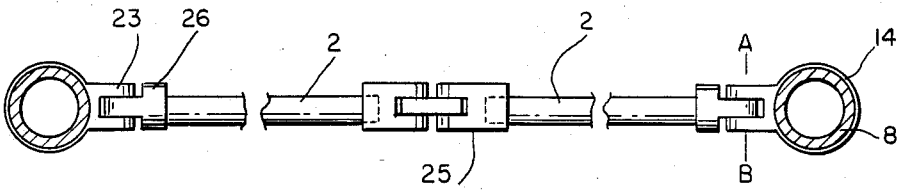
FIG. 13 is a top view of a lower crossbar as it meets the bottom tips of the lower ribs.
Figure 14:
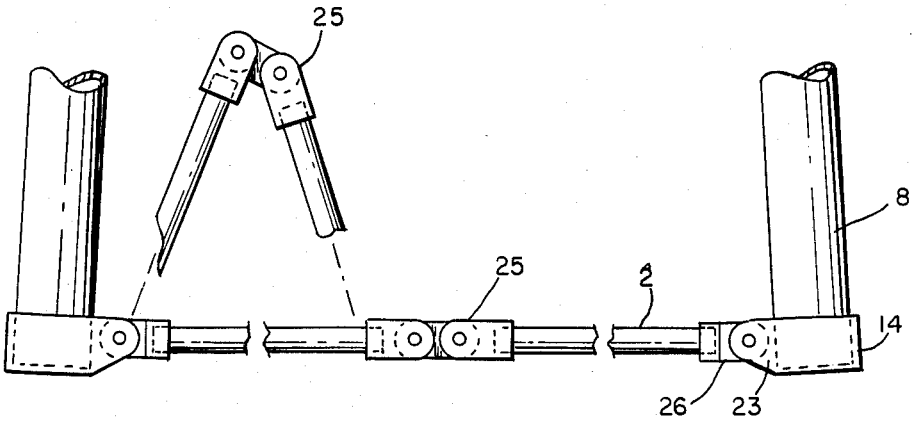
FIG. 14 is a front view of the lower crossbar which is similar to the upper crossbar of FIGS. 11 and 12.

FIG. 13 and 14 show the lower cross bar 2, which is very similar to the upper cross bar 1 except that it is longer. The same principals apply, especially as to the common joints which include plastic caps 14, extending elbows 23 (which are part of the cap 14), cross bar ends 26, and a collapsing hinge 25 which also breaks (or more properly bends) inwardly. This hinge 25 locks firmly in place when the section is fully extended. This is done in coordination with the upper half section. FIG. 13 shows the top view, while FIG. 14 shows the front view of the same hinge. In FIGS. 13 and 14, no pin loops 24 are included in the caps. Such pin loops 24 may be easily included or not as is desired from the common caps 14; and hole would usually be provided in the caps' centers.

FIGS. 15–22 all illustrate various alternative embodiments of how individual units (each composed of two separate sections) can be assembled to form somewhat different shapes and structures. Other uses of the present invention are also contemplated, besides those shown in FIGS. 15–22, which are selected to be representative of the types of uses and not to be an all-inclusive set of examples.

In FIG. 17, only one section is completely expanded while the other section remains collapsed and yet is still attached. FIG. 18 shows both sections slightly dropped. FIG. 19, this configuration is desirable for the person who wishes to sit in a chair under the expanded section while keeping an ice chest or cooler in total shade under the other section. FIGS. 20*a* and 20*b* illustrates two separate sections which are not attached to one another. FIGS. 21 and 22 show the two sections being used, respectively, in full extended position opposite to one another, and in folded condition in parallel with one another.

FIG. 23 illustrates a top view of the sections prior to being folded. In the folding operation, all loose pieces are removed: including poles, cross supports, and anchor pegs (if any). The frame section 101 may remain attached to frame section 102 in the figure. The large dots in FIG. 23 indicate the "breaking point".

FIGS. 24 and 25 show the condition of the invention after being partially folded, in FIG. 24 the upper cross bars and lower cross bars being unsnapped and broken inward at the midpoints, all of the standing ribs in a unit coming together. The fabric or nylon (or any material) body in a preferred embodiment folds accordingly, in a somewhat accordian-style. FIG. 25 is a side view of the somewhat folded configuration. It is noted in FIG. 25 that the center dot indicates a position where no folding has yet taken place. The dot is indicated as portion 103 in FIGS. 24 and 25. Note in FIG. 24 that there are four such locations 103.

FIG. 26 shows the device folded about the dots 103 wherein the extended ribs are collapsed to half-rib size after the middle joint is made free to work, as discussed above.

This small folded package, shown in FIG. 26, readily fits into a bag shown generally schematically in FIG. 27 as bag 98.

In use, the plastic caps and elbow joints are common to every corner. They hold the frame together, when extended fully, in a generally trapezoidal shape.

The hinges make the unit conveniently collapsable and portable. When the upper and lower cross bars are unsnapped and broken inward, as discussed and shown hereinabove, the side ribs come together.

When the ribs are together, the middle joints in the mid-rib areas must be free from the link cover to be permitted to to pivot. The upper ribs will rotate onto the corresponding lower ribs for a full collapse.

What is claimed is:

1. A shelter for protection, comprising a first pair of struts: each said strut having an equal radius of curvature and being of equal length;

a first means for foldably connecting said first pair of struts end to end;

said first pair of struts being selectively positionable between an erected position wherein said first pair of struts forms an S-shaped body and a folded position wherein one of said first pair of struts is superimposed on the other to form a half S-shaped body;

a second pair of curved struts; each said strut having an equal radius of curvature and being of equal length;

a second means for foldably connecting said second pair of struts end to end; said second pair of struts being selectively positionable between an erected position wherein said second pair of struts forms a second S-shaped body and a folded position wherein one of said second pair of struts is superimposed on the other to form a half S-shaped body;

a sheet attached to said first pair of struts and said second pair of struts to form a canopy between said struts;

prop members to support one end of said struts above the ground to form said shelter;

an upper foldable cross bar connecting a first end of said first pair of struts to a first end of said second pair of struts; and a lower foldable cross bar connecting a second portion of said first pair of struts to a second portion of said second pair of struts such that said upper and said lower cross bars are selectively positionable between an extended position wherein said first and said second pairs of struts are spaced apart a predetermined distance and a folded position wherein said first and second pairs of struts are spaced apart a distance less than said predetermined distance; and a cross support member which is foldable about an intermediate portion thereof; and first end of said cross support member contacting an intermediate region of said first pair of struts and a second end of said cross support member connected to an intermediate portion of said second pair of struts.

2. A shelter as claimed in claim 1, further comprising said upper cross bar having a first length and said lower cross bar having a second length; and said first length being less than said second length such that said sheet is substantially trapezoidal in shape and extends between said upper and second lower cross bars.

3. A shelter as claimed in claim 1, wherein said prop members comprise:

a first foldable prop member and a second foldable prop member;

said first foldable prop member being attached adjacent an end of said upper foldable cross bar to support said upper foldable cross bar above a ground surface; and said second foldable proper member being attached adjacent another end of said upper foldable cross bar to support said upper foldable cross bar above a ground surface.

* * * * *